US005117237A

United States Patent [19]

Legg

[11] Patent Number: 5,117,237

[45] Date of Patent: May 26, 1992

[54] QUASI-OPTICAL STRIPLINE DEVICES

[75] Inventor: Thomas H. Legg, Gloucester, Canada

[73] Assignee: National Research Council of Canada, Ottawa, Canada

[21] Appl. No.: 465,309

[22] Filed: Jan. 16, 1990

[30] Foreign Application Priority Data

Jan. 24, 1989 [CA] Canada ..... 589060

[51] Int. Cl.[5] ..... H01Q 3/22; H01P 1/16

[52] U.S. Cl. ..... 342/372; 343/700 MS; 333/21 R

[58] Field of Search ..... 343/700 MS, 754; 342/372; 333/246, 33, 21 R

[56] References Cited

U.S. PATENT DOCUMENTS 3,761,936 9/1973 Archer et al. ..... 343/754
4,001,834 1/1977 Smith ..... 343/754
4,051,476 9/1977 Archer et al. ..... 343/700 MS
4,335,385 6/1982 Hall ..... 343/700 MS
4,500,887 2/1985 Nester ..... 343/700 MS
4,835,496 5/1989 Schellenberg ..... 333/246

*Primary Examiner*—Gregory C. Issing

[57] ABSTRACT

Quasi-optical stripline devices for forming and controlling a beam of radio waves are described. The devices include a strip transmission line having a pair of mutually parallel flat outer conductors and a flat center conductor with a dielectric between them. The center conductor has a narrow channel region, a wide expansion region and a tapered region smoothly connecting the regions. A beam of radio waves propagates freely in the expansion region and can be controlled in a quasi-optical manner by the pattern of the center conductor. The quasi-optical nature facilitates easy visualization of the devices for easy design and manufacture.

13 Claims, 6 Drawing Sheets

QUASI-OPTICAL STRIPLINE DEVICES

FIELD OF THE INVENTION

The present invention relates generally to strip transmission line structures to control or form a beam of radio waves. In particular it is directed to quasi-optical stripline devices which have a patterned center conductor. These devices are conceptually simple and possibly have wide applications because of their- similarity to conventional optical elements in function.

BACKGROUND OF THE INVENTION

In a variety of areas of radio wave transmission and reception, it is necessary to control various parameters of a beam of radio waves such as the shape of a phase front or the distribution of amplitude across the beam, etc. It is also necessary to control the shape of a beam (beam forming). One such area is the collecting or launching of radio waves to or from a receiver or transmitter by way of antennas.

It has been a practice that in building radio receivers and transmitters in the cm to sub-mm wavelength range, it is convenient to use strip transmission lines (striplines for short). Waveguides are also in wide use for sending and receiving radio waves to and from high gain antennas, such as paraboloidal reflector antennas, etc. To couple the stripline to a waveguide feed-horn, however, it is necessary to use a transition section. At cm, but especially at mm and sub-mm wavelengths, highly precise machining is necessary to make the transition sections and waveguides. The bandwidth is also relatively narrow.

U.S. Pat. No. 4,500,887, Feb. 19, 1985, to Nester, describes a microstrip notch antenna which overcomes some of these limitations by eliminating waveguide-stripline coupling. In this device, a microstrip line (an asymmetrical single ground plane stripline) is gradually transformed into a flared notch antenna. Some deficiencies of this device are the tendency of microstrip lines to radiate at bends and discontinuities; the capacity of the notch antennas structure to support surface waves; and the difficulty, with a single ground plane, to sandwich a number of planar structures of this type closely together to form an array of antennas.

Various other stripline antennas have been proposed. U.S. Pat. No. 4,335,385, Jun. 15, 1982, Hall, teaches one type of antenna in which an appropriate combination of right-angle corners in stripline produces the desired polarization in radio waves being radiated into free space. U.S. Pat. No. 4,001,834, Jan. 4, 1977, Smith, on the other hand, describes printed wiring antennas and arrays. Each antenna is made of printed wiring on a single card which integrally includes printed transmission feedlines. An array of such cards can be fabricated into a radiant energy lens.

OBJECTS OF THE INVENTION

It is therefore an object of the present invention to provide an efficient and wide-band stripline structures to radiate or collect a beam of radio waves.

It is another object of the present invention to provide a wide band stripline structure which efficiently controls and forms a beam of radio waves.

It is still another object of the present invention to provide a stripline device which is easy and economical to manufacture.

It is yet another object of the present invention to provide a stripline device which is easy to design for feeding efficiently a large reflector antenna.

It is a further object of the present invention to provide a stripline device which can be stacked together to produce a two-dimensional array antenna.

SUMMARY OF THE INVENTION

The present invention obviates the prior art difficulties and provides an efficient and very wide band stripline structures to radiate or collect a beam of radio waves. The stripline structures of the present invention can be fabricated with a planar photolithographic process in which photographically-reduced, large-scale drawings provide the high precision needed for sub-mm wavelengths, without the need for precision machining.

Briefly stated, the stripline device according to one embodiment of the present invention has a strip transmission line which includes a pair of flat and mutually parallel outer conductors and a flat center conductor located at substantially midpoint between and in parallel with the outer conductors. The spaces between the outer conductors and the center conductor are filled with a dielectric material. The center conductor has a predetermined conductive pattern which includes a narrow channel region, a wide expansion region, and a tapered region smoothly connecting the narrow channel region and the wide expansion region.

BRIEF DESCRIPTION OF THE DRAWINGS

Other objects, features and advantages of the present invention will be apparent from the following description taken in connection with the accompanying drawings, wherein.

DETAILED DESCRIPTION OF PREFERRED EMBODIMENTS OF THE INVENTION

While the quasi-optical stripline devices of the present invention have many other uses in controlling and forming radio wave beams as will be described later, it is believed that a description of the prior art transition section would be helpful in appreciating the present invention more thoroughly.

Figure 1A:
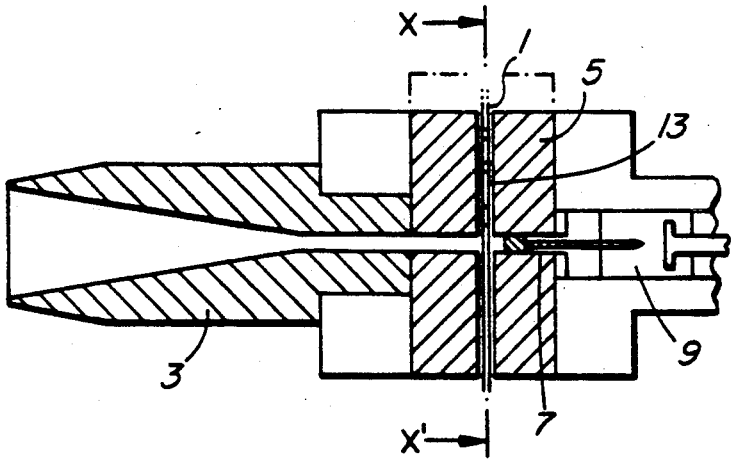
FIGS. 1*a* and 1*b* are respectively a schematic illustration of a typical waveguide transition section and its cross-sectional view taken through lines X—X'.
Figure 1B:
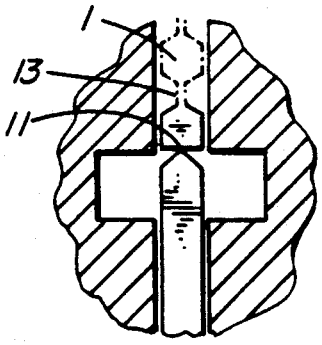

FIG. 1*a* shows a widely used coupling between the strip transmission line 1 and a waveguide feed horn 3 by the use of a transition section 5. The section 5 includes a back-short 7 which is mechanically adjustably positioned about a quarter wavelength from the center conductor of the stripline 1 by a mechanism 9. As shown in FIG. 1*b*, a SIS (superconductor-insulator-superconductor) mixer junction 11 is located at the end of the stripline 1 which also includes such RF elements 13 as chokes, filters, etc. To some extent at cm, but especially at mm and submm wavelenths, highly precise machining is necessary to make the waveguide horn, and transition section. Furthermore, a backshort is required which needs to be mechanically positioned. With a receiver using SIS junctions, the backshort reduces reliability and is expensive because it must be adjusted within a cryogenic vacuum chamber.

Figure 2A:
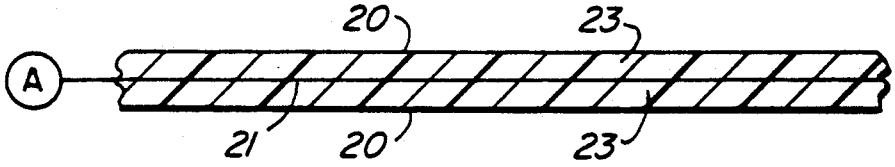
FIGS. 2*a* and 2*b* are a side and a plan view respectively of a stripline horn-like structure according to one embodiment of the invention.
Figure 2B:
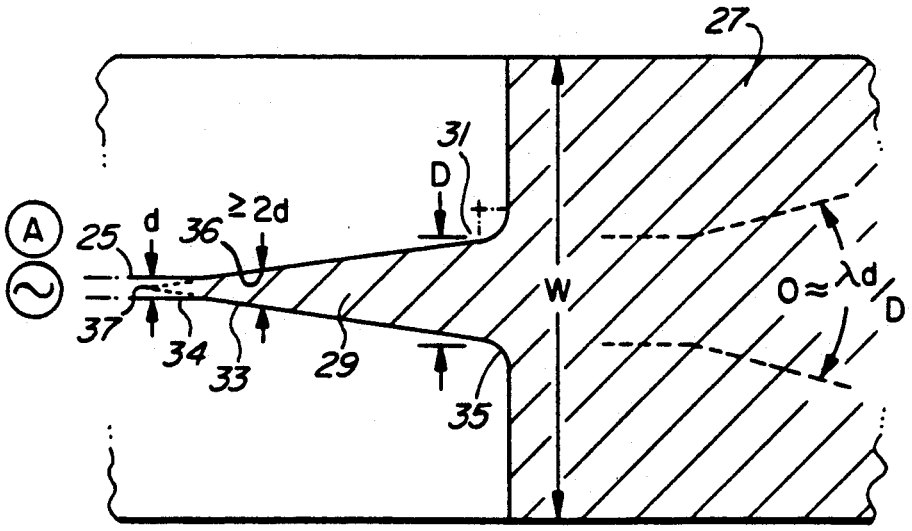

FIGS. 2*a* and 2*b* show a quasi-optical stripline device according to one embodiment of the invention for controlling and forming beams of radio waves for the purpose of launching or collecting. In FIG. 2*a*, the stripline device is formed by flat outer conductors 20 functioning as the groundplane and a flat center conductor 21 separated by dielectric substrates 23 which can be open space filled with air or with solid dielectric. The center conductor is shown in detail in FIG. 2*b* and has a narrow channel region 25 and a wide expansion region 27. A tapered region 29 smoothly connects the narrow channel region 25 and the expansion region 27. The width of the narrow channel region d can be chosen to match the impedance of the device being fed (such as a SIS mixer junction) located at "A". The tapered region 29 ends at a mouth 31 where the width is D. The expansion region 27 is of width W, which is considerably wider than D. If a transmitter is located at "A" instead of an SIS mixer junction, the sudden change in flare angle at 31 results in a beam of radio waves being launched into the region 27 with a beam width of angular dimension $\theta \approx \lambda_d/D$, where $\lambda_d$ is the wavelength of the radio waves in the dielectric. The flared sections of stripline such as that shown in FIG. 2*b* are thus similar to H-plane sectoral (two-dimensional) horns. They will hereafter be called stripline horns.

(a) Stripline horns

Some further features of a practical stripline horn with a linearly tapered region are illustrated in FIG. 2*b*. For wide bandwidth, a fillet 33 is needed at the throat 34, and a curved flare 35 at the mouth 31. The fillet is ideally exponential in shape, and very long. In practice, it is found that any reasonably shaped curve will serve. For example, a circular arc tangent to both the narrow channel region 25 and to the tapered region 29 is satisfactory. The length of the fillet should be such that the width of the center conductor at one end 36 of the fillet is at least 2*d*. A curved flare 35 at the mouth 31 is also useful in reducing reflections. Again, there does not seem to be great sensitivity in behaviour to the exact form of the curve. A flare which is found to serve well in practice is a circular arc which is tangent to the edge of wide expansion region 27, and tangent to the tapered region near the mouth 31. An arc radius of approximately D/4 is usually appropriate, where D is the width of the center conductor at the end of the flare as shown in the figure. A flare of radius much larger than this will change the effective width of the horn mouth.

Figure 3:
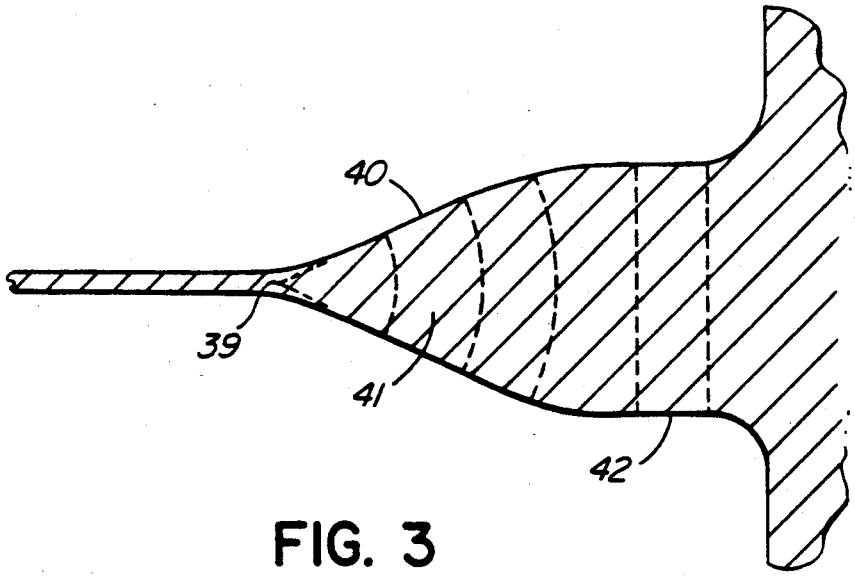
FIG. 3 is a pattern of the center conductor of a stripline horn according to another embodiment of the invention.

The long-wavelength limit of the horn, i.e. the longest wavelength for which reflection is low, is typically equal to the distance in which the line width increases from d to about 3d. A linearly tapered similar to that drawn in FIG. 2*b* was found to have VSWR of less than 1.3 over a bandwidth of 6:1. The amplitude distribution across the mouth 31 of a moderately tapered horn is essentially constant and the phase front essentially circular in shape with a center of curvature at the apex of taper 37 in the stripline device of FIG. 2*b*. The phase front can be straightened by making the edges of the horn parallel as illustrated in FIG. 3. In this figure, the phase fronts are shown schematically by dotted lines together with the apex 39 of .the straight section 40 of taper. Thus in addition to the taper, the center conductor 41 has parallel sides 42. Smooth transitions in the pattern reduce undesired reflections of radio waves.

Figure 4:
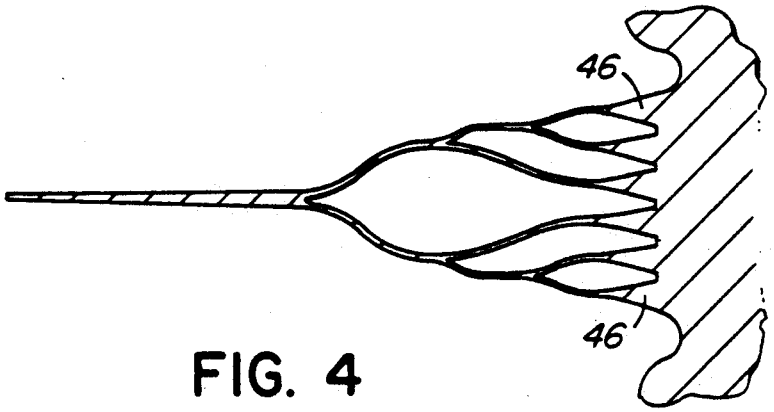
FIG. 4 is a pattern of the center conductor of a stripline device according to still another embodiment having a plurality of horns.

Both the amplitude and phase across the mouth can be controlled, at least in a step-wise fashion, by dividing the mouth into a number of small horns fed through stripline power dividers. FIG. 4 shows an example where six small horns, 46 are fed in a ratio of power following a binominal distribution (1:5:10:10:5:1) which results in a beam of near Gaussian shape. The phase lengths of the lines feeding the six horns of this embodiment are equal. They could, however, be chosen to give a step-wise approximation to any arbitrary phase distribution. The ratio of curve-radius to stripline-width for the horn in FIG. 4 is ~20, a condition which helps to ensure a low VSWR. For good isolation between the lines, the spacing between them should be two or more times the center conductor to ground plane spacing. This spacing therefore controls the size of the small horns and therefore influences their number.

(b) Stripline Lenses and Reflecting Sections

Figure 5:
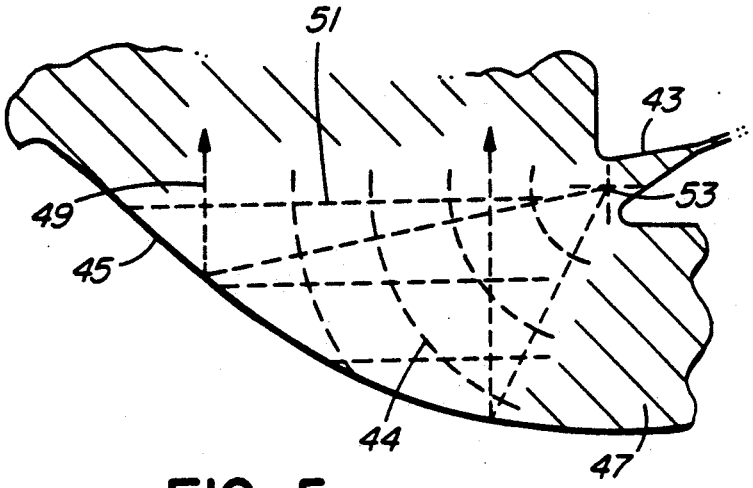
FIG. 5 is a pattern of the center conductor in which a stripline horn and a reflector are combined according to one aspect of the invention.
Figure 6:
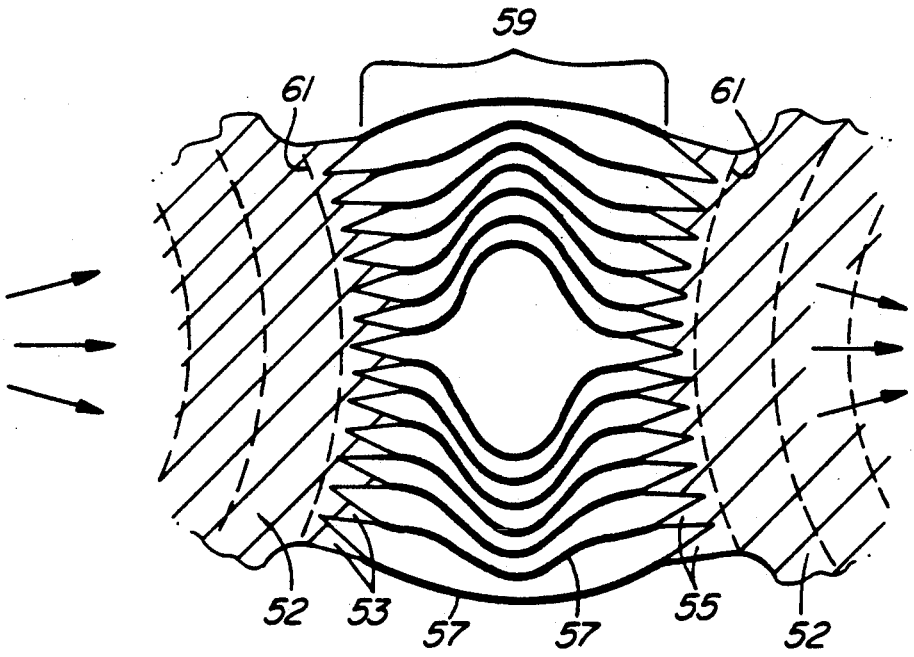
FIGS. 6 and 7 are patterns of the center conductors of a path-length lens and reflector lens respectively of the present invention.

The beam formed by a stripline horn can be modified with a curved reflector, a path-length lens or a combination of reflector and lens. One embodiment of a curved reflector is shown in FIG. 5. Here an off-set stripline horn 43 directs a beam having wavefronts 44 towards the curved edge 45 of the center conductor 47, whence the beam 49 is reflected with a re-shaped wavefront 51. The focus of the curved edge is at 53. The curved reflector can also be formed by physically shaping (grinding, for example) edges of the two dielectric substrates and then coating the edges with a film of conductor. The edges so formed can also be made to serve as a "mode-converter" as described below. FIG. 6 depicts an embodiment of a path-length lens having the center conductor made into a specific pattern. The radio beam is collected and re-radiated by two sets of small horns 53 and 55 joined by stripline sections 57 of different path-length 56. Useful variables that can be exploited in the design of a lens are the envelopes 61 (on both sides of the lens) of the mouths of the horns, and the path-lengths between the horns. A particular application is with a multiple-beam feed where such a lens allows two perfect off-axis foci, thereby giving a good off-axis beam forming characteristic.

Figure 7:
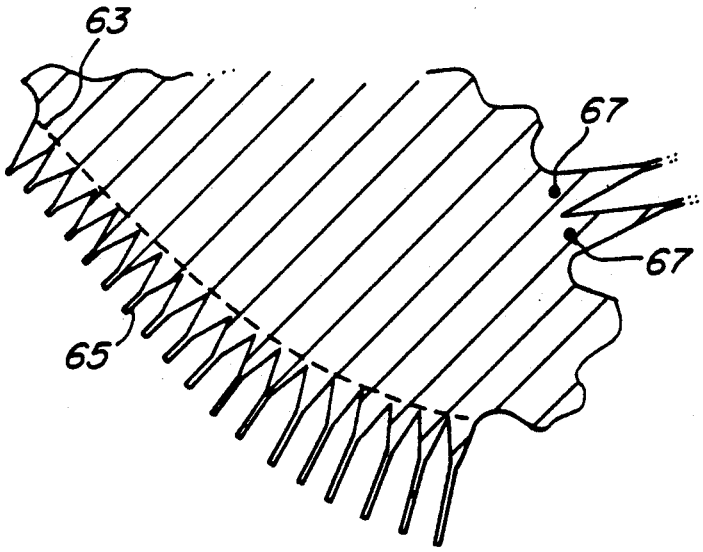

Another device to control the beam phase and amplitude is a combined reflector and lens illustrated in FIG. 7. Here the envelope of the horn-mouth positions 63 and the path lengths of the reflecting open-circuited transmission lines 65, give two degrees of freedom allowing some control of both amplitude and phase. The specific embodiment shown in the figure is a device with two foci 67 wherein cylindrical waves originating at either of the two foci are converted into waves with straight phase fronts, travelling in different directions. The reflector-lens of FIG. 7 requires less space than the path-length lens of FIG. 6, but must be used with an offset feed to avoid feed blockage.

A very important characteristic of the invention is the general way in which lenses and curved reflectors can be applied in a stripline region. Many of the uses for lenses and mirrors in conventional optics can be envisaged for stripline lenses and mirrors at cm and sub-mm wavelengths. The only limitation is imposed by diffraction effects resulting from the relatively small dimensions (in terms of wavelengths) at cm or even sub-mm wavelengths.

(c) Mode converters

Figure 8:
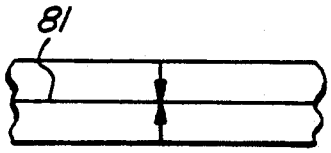
FIGS. 8 and 9 are schematic illustrations of the electric field of the stripline mode and of the parallel plate mode respectively.
Figure 9:
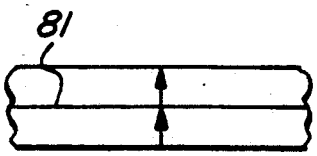

To have the radio beam radiate outside of the stripline region it is necessary to change the relative phase of the electric field on either side of the plane of the center conductor by 180°. The electric field configuration must be changed from the stripline mode of FIG. 8 to the parallel-plane mode of FIG. 9. In FIG. 9, the center conductor 81 does not perturb the field configuration and thus no effect on the propagating radio waves. Several embodiments of accomplishing this phase conversion are illustrated in the following figures.

Figure 10A:
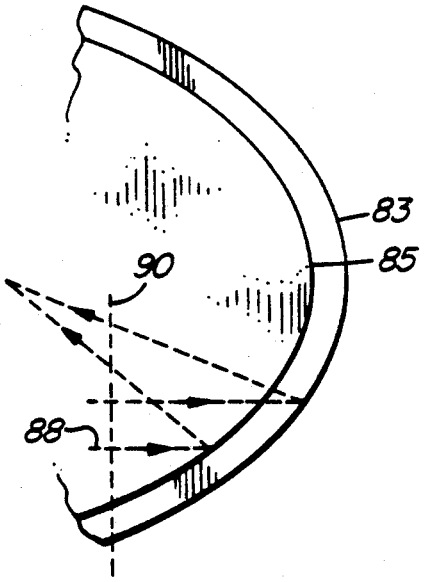
FIGS. 10*a* and 10*b* are a plan view and a side view of the stripline device according to an embodiment of the invention in which a mode conversion means is provided.
Figure 10B:
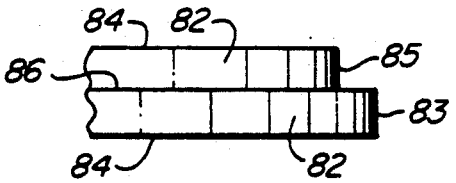

In FIGS. 10*a* and 10*b*, an edge of the two dielectric substrates 82, which separate the outer conductors 84 and the center conductor 86, is shown used as a reflector. The edges 83 and 85 can be straight or curved (with parabolic profile for example), are coated with a conducting film, and are displaced so as to provide, upon reflection, the required half-wavelength (180°) difference in path length on the two sides of the center conductor. The beam directions and the wavefront before reflection are also shown respectively at 88 and 90. Although simple, this scheme of mode conversion is relatively a narrow band, because it is wavelength dependent.

Figure 11A:
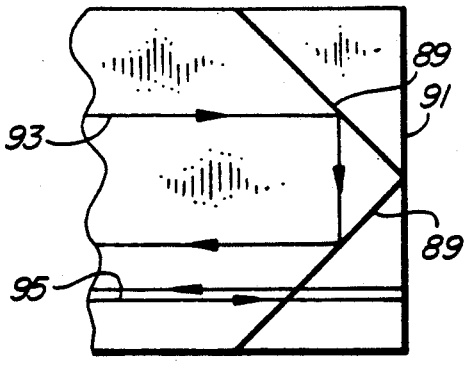
FIGS. 11*a* and 11*b* are a plan view and a side view respectively of a stripline device in which a mode conversion means of a different kind is present.
Figure 11B:
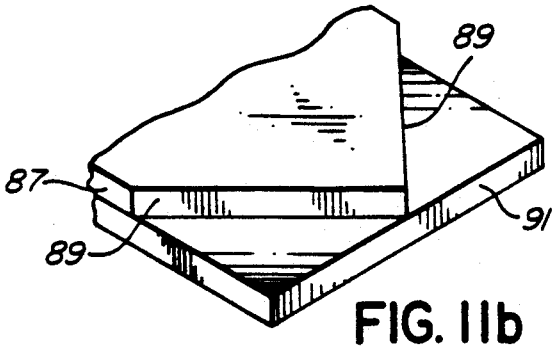

A wider-band means of obtaining the 180° phase difference is to arrange an odd difference in the number of reflections on the two sides of the center conductor, while maintaining the same physical path length. An example is shown in FIGS. 11*a* and 11*b*. As seen in FIG. 11*a*, the upper dielectric layer 87 is cut away and edges 89 and 91 are coated with conductor to act as reflectors, but while two reflections take place form edge 89 as shown by the line 93, each changing the electric field by 180°, there is only one from edge 91, as shown by line 95. This arrangement does not limit the bandwidth but, because of the axial symmetry involved, is only useful with a single symmetrically placed horn.

Figure 12:
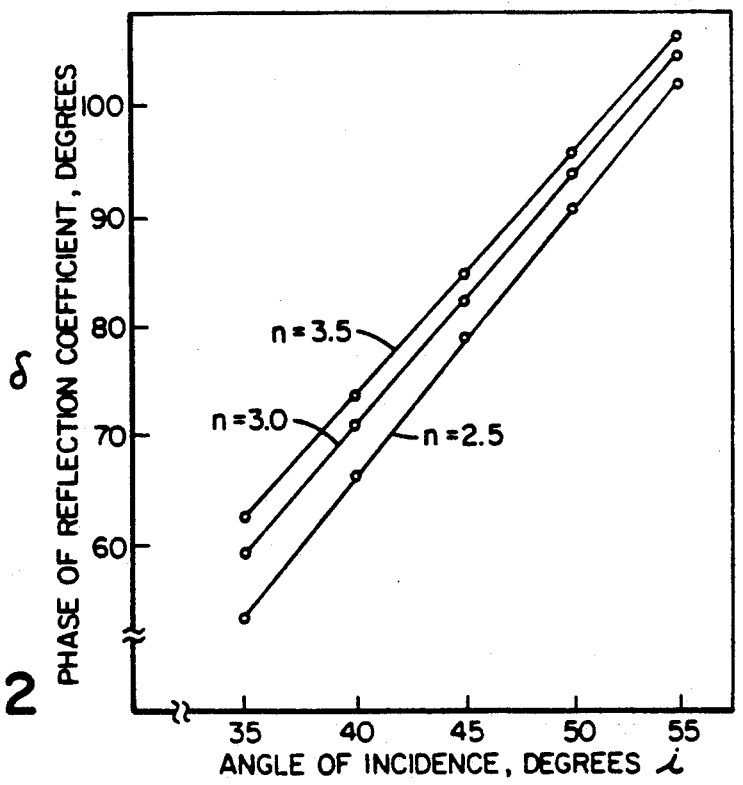
FIG. 12 is a graph which illustrates still another mode conversion mechanism.

A third means of obtaining the 180° phase shift uses the phase difference between a reflection from a conductor and the total internal reflection at an air-dielectric (or vacuum-dielectric) interface. The phase of the reflection coefficient for total internal reflection, say $\delta$, depends upon the angle of incidence i, according to the standard optical formula:

$$\tan\frac{\delta}{2} = (\sin^2 i - n^{-2})^{\frac{1}{2}}/\cos i$$

where "n" is the refractive index of the dielectric, and dielectric constant outside of the dielectric is assumed to be unity. It is important to note that this phase does not depend upon wavelength. The variation of $\delta$ with i is plotted in FIG. 12 for three values of n. Two reflections are needed to achieve a difference of 180° between internal reflections on one side of the stripline center conductor, and reflections from a conductor on the other side. Good off-axis characteristics are ensured by the near linearity of the curves in FIG. 12. If the first reflection is at an angle $\theta+i$, the second will be at $\theta-i$, and the combined phase shift will be essentially the same as for an incidence $\theta$, i.e. independent of any offset.

Figure 13A:
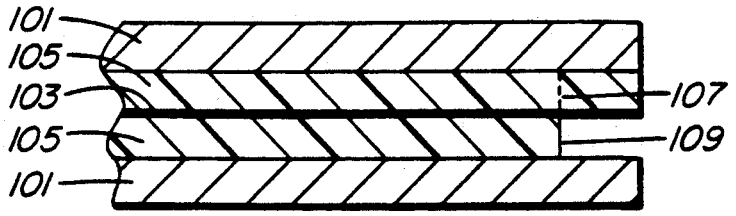
FIGS. 13*a* and 13*b* are a side view and a plan view respectively of a practical embodiment using the principle.
Figure 13B:
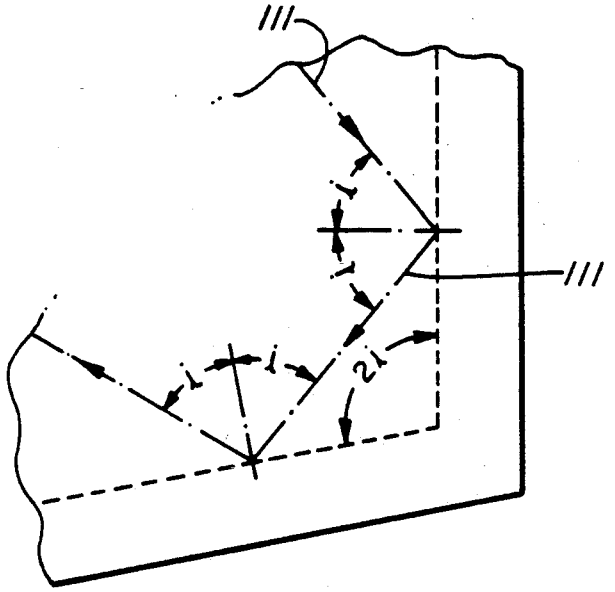

A practical embodiment for this type of mode conversion is illustrated schematically in FIGS. 13*a* and 13*b*. In FIG. 13*a*, metal base plates 101 are the outer conductors and sandwich the center conductor 103 with dielectric 105 between them. There is a conductive layer 107 positioned within the dielectric on one side of the center conductor. The dielectric on the other side of the center conductor is left uncoated at its edge 109. The dielectrics are shaped as shown in the plan view of FIG. 13*b*. The beam of radio waves travels along the path 111 both above and below the center conductor and reflects twice at the edges of the dielectric and at the conductive layer. An examplary angle of incidence and the angle subtended by the dielectric edges are shown as i and 2i in the figure.

Figure 14:
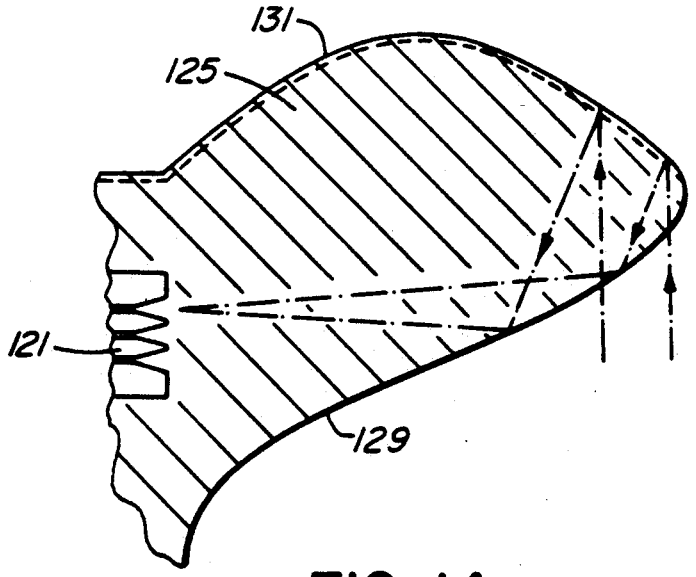
FIGS. 14 to 17 show further embodiments of the present invention.
Figure 15:
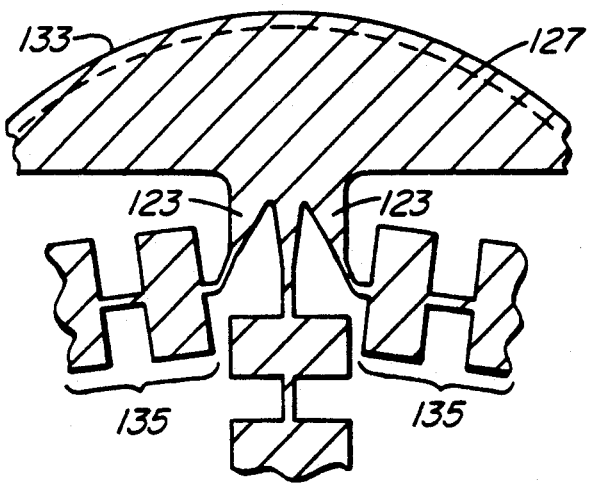

It is important to note that once the field has been converted to parallel plate mode, it is essentially unaffected by the center conductor which thus becomes transparent to the wave. Stripline horns, lenses, transmission lines, or other planar components therefore do not block the reflected parallel plate wave. FIGS. 14 and 15 show some examples where horns 121 and 123, expansion regions 125 and 127, and curved edge 129 are located in front of a mode converting element 131 and 133, and do not block the reflected parallel plate waves. In FIG. 14, stripline IF filters, RF chokes and SIS junctions are located at 135.

(d) The beam in the orthogonal direction

Figure 16:
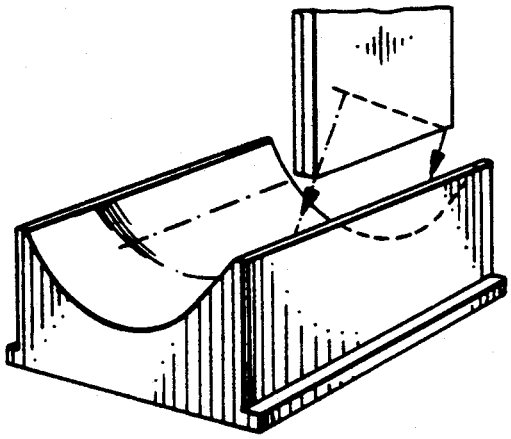
Figure 17:
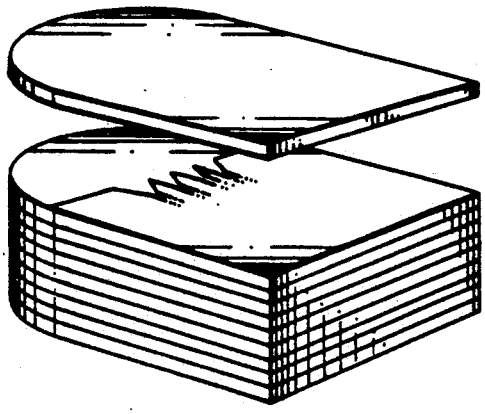

The parallel plate mode will radiate from the edge of the stripline structure. The pattern radiated will be fan-shaped: broad orthogonal to the planar substrate and narrow in the plane of the structure. To obtain a pencil beam, one that is narrow in both planes, the stripline structure can be used as a line source for a cylindrical reflector (e.g. parabolic profile) as shown in FIG. 16. This is best accomplished by forming a beam within the stripline region with a wavefront that is straight but at an angle to the edge of the substrate. The cylinder can then be fed in an offset manner that avoids blockage by the feed. Several stripline structures can be sandwiched together to feed the cylindrical reflector, as shown in FIG. 17. If there are n such structures, each having m stripline horns, a two-dimensional m by n array of beams will be obtained. If a solid dielectric is used, reflection from air-dielectric interface can be reduced by standard microwave technique. For example, the thickness of dielectric may be tapered from zero to full thickness over a distance equal to or greater than, the longest desired operating wavelength.

I claim:

1. A quasi-optical stripline device for forming and controlling a beam of radio waves, comprising:

a strip transmission line including a pair of flat and mutually parallel outer conductors, a flat center conductor located at substantially the midpoint between and in parallel with the said out conductors, a dielectric material filling the space between the said outer and center conductors, the said center conductor having a predetermined conductive pattern which includes a narrow channel region, a wide expansion region and a tapered region smoothly connecting the said narrow channel region and the said wide expansion region, and phase shifting means in the said wide expansion region for changing the relative phase of an electric field in the said dielectric material by 180° so that the propagating mode of the said beam of radio waves is changed between the stripline mode and the parallel plate mode.

2. The quasi-optical stripline device according to claim 1 wherein the said center conductor has a curved tapered region to generate a predetermined wavefront in the beam of radio waves propagating therethrough.

3. The quasi-optical stripline device according to claim 1 wherein the said center conductor has a plurality of tapered regions which are specifically arranged with each other in a predetermined fashion.

4. The quasi-optical stripline device according to claim 2 wherein the said center conductor has a plurality of tapered regions which are specifically arranged with each other in a predetermined fashion.

5. The quasi-optical stripline device according to claim 3 wherein:

the said center conductor has two sets of a plurality of tapered regions, the tapered regions of one set being connected electronically with the tapered regions of the other set by a plurality of transmission lines of different lengths so that predetermined mutual phase differences are generated among radio waves propagating through the said transmission lines.

6. The quasi-optical stripline device according to claim 1 wherein the said wide expansion region includes a plurality of horns specifically arranged with each other and having mutually different tapered regions and narrow channel regions so that a beam of radio waves is reflected therefrom in a specific pattern due to phase differences created in the tapered and narrow regions.

7. The quasi-optical stripline device according to claim 1 wherein the said phase shifting means comprises a reflection edge along which the said outer conductors are offset by a quarter wavelength.

8. The quasi-optical stripline device according to claim 1 wherein the said phase shifting means comprises a reflection means in which the outer conductors are shaped differently with each other so that the propagating electric field on one side of the center conductor reflects an odd number-times more than the propagating electric field on the other side of the center conductor does, to generate a 180° relative phase difference between the said propagating electric fields.

9. The quasi-optical stripline device according to claim 1 wherein the said phase shifting means comprises specifically shaped edges of the dielectric material, the edges on one side of the center conductor being coated with conductive material and those on the other side thereof being left uncoated so that the propagating electric fields undergo predetermined difference in phase shift upon reflection at the edges coated with a conductive material and those left uncoated.

10. The quasi-optical stripline device according to claim 2 wherein the said phase shifting means comprises a reflection edge along which the said outer conductors are offset by a quarter wavelength.

11. The quasi-optical stripline device according to claim 1 wherein the said center conductor has a predetermined conductive pattern which includes a plurality of narrow channel regions and a plurality of tapered regions, each of the tapered regions smoothly connecting each of the narrow channel regions and the expansion region.

12. The quasi-optical stripline device according to claim 1 further comprising external reflector means positioned relative to the said phase shifting means for forming a beam of radio waves into a predetermined shape.

13. The quasi-optical stripline device according to claim 1 wherein a plurality of the said outer conductors and a plurality of the said center conductors are stacked one upon the other.

* * * * *